US010737487B2

(12) United States Patent
De Carvalho Costa et al.

(10) Patent No.: US 10,737,487 B2
(45) Date of Patent: Aug. 11, 2020

(54) MARKING ASSEMBLY AND METHOD

(71) Applicant: SICPA HOLDING SA, Prilly (CH)

(72) Inventors: Diego De Carvalho Costa, Rio de Janeiro (BR); Raynier Douglas Barbosa Gomes, Rio de Janeiro (BR)

(73) Assignee: SICPA HOLDINGS SA, Prilly (CH)

( * ) Notice: Subject to any disclaimer, the term of this patent is extended or adjusted under 35 U.S.C. 154(b) by 0 days.

(21) Appl. No.: 16/469,095

(22) PCT Filed: Nov. 8, 2017

(86) PCT No.: PCT/EP2017/078589

§ 371 (c)(1),
(2) Date: Jun. 12, 2019

(87) PCT Pub. No.: WO2018/108391

PCT Pub. Date: Jun. 21, 2018

(65) Prior Publication Data

US 2020/0070501 A1 Mar. 5, 2020

(30) Foreign Application Priority Data

Dec. 12, 2016 (WO) ..... PCT/EP2016/080610

(51) Int. Cl.
*B41J 2/045* (2006.01)
*B41J 3/407* (2006.01)
(Continued)

(52) U.S. Cl.
CPC ..... *B41J 2/04505* (2013.01); *B41J 2/04586* (2013.01); *B41J 3/4073* (2013.01); *B41J 25/304* (2013.01); *B41M 5/0041* (2013.01)

(58) Field of Classification Search
CPC .. B41J 2/17596; B41J 25/304; B41J 2/04505; B41J 2/04586; B41J 3/4073;
(Continued)

(56) References Cited

U.S. PATENT DOCUMENTS 7,434,902 B2 10/2008 Baker et al.
2012/0069089 A1* 3/2012 Hendricks ..... B41J 25/3088 347/37
(Continued)

FOREIGN PATENT DOCUMENTS

EP 0534337 3/1993
EP 0993957 4/2000
WO 2013046344 4/2013

OTHER PUBLICATIONS

International Search Report and Written Opinion issued with respect to application No. PCT/EP2017/078589.
(Continued)

*Primary Examiner* — Jannelle M Lebron
(74) *Attorney, Agent, or Firm* — Muncy, Geissler, Olds & Lowe, P.C.

(57) ABSTRACT

The present invention refers to a marking assembly suitable for providing markings, for example a text, an image, a barcode, or the like, on objects like containers, packages or products. The marking assembly comprises a control unit configured to receive a signal from a sensor and configured to either activate an actuator to move a marking device to an elevated position with an increased speed, or to activate a release device to disengage the actuator, thereby moving the marking device by a counterweight.

15 Claims, 1 Drawing Sheet

(51) Int. Cl.
*B41M 5/00* (2006.01)
*B41J 25/304* (2006.01)

(58) Field of Classification Search
CPC ..... B41J 3/4078; B41J 3/407; B41J 25/308; B41J 25/3082; B41J 25/3088; B41M 5/0041
See application file for complete search history.

(56) References Cited

U.S. PATENT DOCUMENTS

2015/0360462 A1 12/2015 Lowrance et al.
2017/0151817 A1* 6/2017 Takakusa ..... B41J 25/304

OTHER PUBLICATIONS

International Preliminary Report on Patentability issued with respect to application No. PCT/EP2017/078589.

* cited by examiner

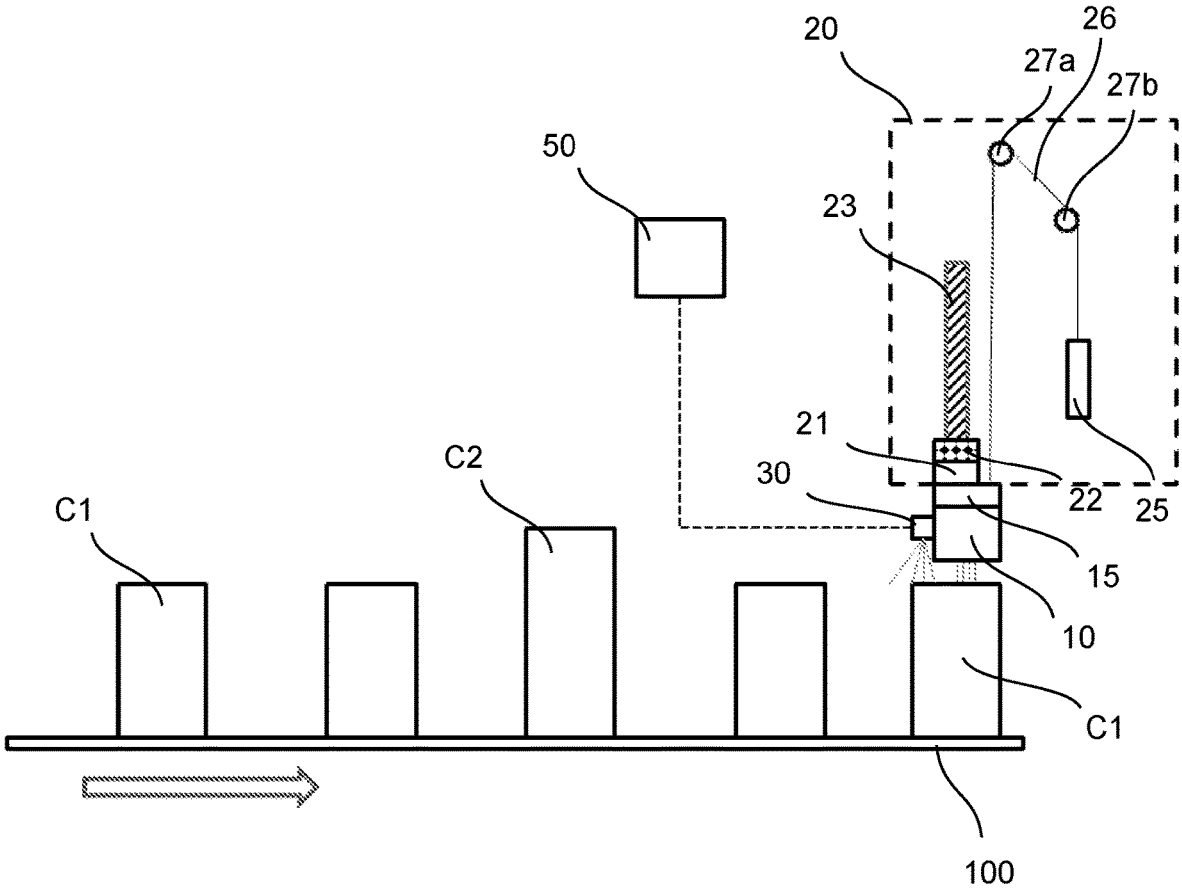
20
26
27a
27b
50
23
21
22
25
30
15
10
C2
C1
C1
100

MARKING ASSEMBLY AND METHOD

TECHNICAL FIELD

The present invention refers to a marking assembly suitable for providing markings, for example a text, an image, a barcode, or the like, on objects like containers, packages or products (hereafter "container") conveyed by a conveyor. Specific examples of such containers are bottles, boxes or parcels.

BACKGROUND

Printing devices for printing a marking on a moving container are known in the art. Conventional print head assemblies usually comprise a motor so as to adjust the height position of the print head relatively to a conveyor so that containers of different heights may be processed.

For example, EP 0 534 337 A1 refers to a printing device for printing a marking on objects, which are continuously moved forward, in particular for parcels, wrapped magazine piles or the like. The printing device comprises a transport path alongside of which the objects can be transported at a defined rate of speed. By means of an adjustable matrix printing head, the surface to be printed of the objects can be printed in contactless manner when they pass the printing head. A scanning member, in particular an infrared distance sensor, is arranged at a distance before the printing head and scans the position of the surface to be printed of the objects and tracks the printing head according to the position of the surface to be printed of the objections by corresponding control over and adjustment device of the printing head.

Although the device of EP 0 534 337 A1 is suitable for adjusting the position of a print head, a situation may occur where the scanning member fails to detect an object or to correctly detect the height of such an object. Consequently, the object moved along the transport path will collide with the print head.

Another document is U.S. Pat. No. 7,434,902 B2 referring to a printheads and a system using printheads. The printing apparatus comprises a jetting assembly including a plurality of nozzles for ejecting droplets on a substrate moving relative to the jetting assembly and a mechanism for increasing the displacement of the jetting assembly relative to the substrate. Additionally, a sensor is provided, which includes a transmitter mounted on one side of the conveyor and a receiver mounted to an opposite side of the conveyor in a so-called "electric-eye" arrangement. If a substrate conveyed by the conveyor has a height that exceeds the spacing, the beam of light is interrupted and the transmitter sends a signal to a lift actuator so as to raise the mounting rack and the print head clusters above the substrate and also provides a signal to the print head clusters to interrupt the printing process.

SUMMARY OF THE INVENTION

One of the objects of the present invention is to provide a marking assembly which may avoid one of the above-mentioned drawbacks, and/or a marking assembly which reliably processes containers of varying heights.

Claim 1 provides a marking assembly according to one aspect of the present invention. Further preferred embodiments are outlined in the dependent claims and in the following description.

The marking assembly comprises a marking device, for example an ink jet head, configured to provide a marking on an object passing the marking device. Thus, the marking device is suitable for providing a marking on an upper surface of an object like a container, in particular a bottle, a box, a parcel or the like.

In a preferred embodiment, the marking device is disposed so that an object may pass adjacent or below the marking device.

The marking assembly also includes a positioning mechanism, wherein the positioning mechanism comprises an actuator for moving the marking device in a vertical direction. Additionally or separately, the positioning mechanism comprises a counterweight. The actuator may be an electric mechanical actuator.

Further, the marking assembly comprises a release device, which may according to a specific embodiment be a solenoid valve, for disengaging the actuator. A sensor is provided on the marking device or the positioning mechanism, being suitable for detecting an object approaching the marking device.

For example, the sensor may face vertically downwards. Thus, the sensor is suitable for detecting a container present in an area below the sensor. The sensor may be for example an optical sensor, an ultrasound sensor, a radar sensor, or the like.

Additionally, the marking assembly comprises a control unit configured to receive a signal from the sensor and to either activate the actuator moving with an increased speed or to activate the release device for disengaging the actuator.

Consequently, the present invention provides a marking assembly with safety features for avoiding a collision with a container. If the sensor detects a container which would collide with the print head, since the position of the marking device is not correctly adjusted, a first step could be to activate the actuator, thereby moving the marking device with high or even maximum speed in a vertical direction so as to avoid collision. If the actuator fails to move the marking device or if the controller recognizes that the acceleration which could be provided by the actuator will not be sufficient for avoiding a collision, the control unit is configured to send a signal to the release device which disengages the actuator, thereby moving the marking device by the counterweight.

Thus, a collision can be reliably avoided, even if unforeseen circumstances occur, like power failure or a defect of the actuator.

According to a preferred embodiment, the sensor is a diffused sensor. The diffused sensor may send out a light beam that diffuses in all directions. If any portion of a container has a height that exceeds the predetermined height, the light beam is interrupted and the sensor is triggered. Subsequently, the sensor may send a signal to a control unit, which is preferably a programmer logical controller (PLC). The control unit receives the signal and may send a signal to the actuator to move up with a maximum speed in order to avoid a collision, or to activate the released device to disengage the actuator.

According to a preferred embodiment, the actuator is a servomotor, in particular a servomotor with a mechanical spindle axis, which is particularly useful for providing a high precision and high rotation rate.

According to a preferred embodiment, the control unit is configured to activate the release device, if activating the actuator fails. Thereby, a collision of an object with the marking device may be reliably avoided.

The control unit may be configured to detect a power failure so that the control unit activates the release device to disengage the actuator, thereby moving the marking device by the counterweight. Thus, even under those circumstances, a collision may be reliably avoided.

In another preferred embodiment, the control unit is configured to detect failure of the sensor so that the control unit activates the actuator to move the marking device to an elevated position.

The control unit may also be configured to detect a failure of the actuator so that the control unit activates the release device to disengage the actuator, thereby moving the marking device the counterweight.

Thus, even under those circumstances, a collision may be reliably avoided.

The marking device is preferably provided on a beam movably guided by a vertical guide, wherein the actuator and/or the release device are mounted on the beam.

According to another modification, the above mentioned increased speed is a maximum speed of the actuator.

The control unit is, according to a preferred embodiment, a centralized control unit. According to a further embodiment, the control unit may be a decentralized control unit, which is in particular provided on the marking device or the actuator. According to a preferred embodiment, the control unit is a programmer logical controller (PLC). Therefore, the control unit may quickly receive and send commands to the corresponding elements of the device.

The present invention further refers to a conveyor comprising a conveying element for conveying objects and a marking assembly according to any of previous aspects. Similar positive effects may be obtained by a conveyor comprising the marking assembly.

Further, the present invention refers to a method for adjusting a position of a marking device of a marking assembly. According to a preferred option, a marking assembly according to any of claims 1-10 may be used with this method. The method comprises the following steps:

Moving an object, in particular a container, in a conveying direction, Detecting the object by an optical sensor provided on or in proximity to the marking device of the marking assembly, and determining to activate an actuator an increased speed, or to activate a release device for disengaging the actuator, thereby elevating the marking device by a counterweight connected to the marking device.

BRIEF DESCRIPTION OF THE DRAWINGS

The invention may be better understood by reference to the following specification and taken in conjunction with the accompanying drawings.

The sole FIGURE is a schematic drawing showing a preferred embodiment of the present invention

DETAILED DESCRIPTION OF A PREFERRED EMBODIMENT

A preferred embodiment of the present invention is hereafter described in further detail. The description and the accompanying schematic drawing are to be construed by ways of example and not of limitation. In particular, modifications of specific elements of the preferred embodiment described hereafter may be combined with other modifications so as to provide further embodiments of the present invention.

The sole FIGURE schematically shows a conveyor 100 comprising a marking assembly according to an embodiment of the present invention. In particular, the conveyor 100, which may comprise a conveyor belt or rollers for moving containers C1, C2 (objects) in a conveying direction (arrow in the sole FIGURE) is provided, wherein a print head 10 (marking device) of the marking assembly is configured to provide a marking on an upper surface of the containers C1, C2.

The print head 10, which may be an ink-jet printing head, comprises printing nozzles, which are facing vertically downwards. The print head 10 is attached to a rack or beam 15 extending transversely over the conveyor 100.

The marking assembly further includes a positioning mechanism 20, which comprises a servo motor (actuator) 21 for moving the print head 10 upwards and downwards along a guide rail 23. The guide rail 23 extends in a vertical direction and provides guidance for the beam 15 when moving upwards and downwards.

A releasing device 22 is provided on the beam 15 and attached on the electric mechanical actuator. The servomotor is coupled on the electric mechanical actuator, which is according to the preferred embodiment a solenoid valve. The solenoid valve 22 is configured to disengage the pinterhead arm.

The positioning mechanism 20 further comprises a counterweight 25, which is connected to the beam 15 via a (steel) cable 26. The cord 26 extends from an upper portion of the beam 15, is deflected by guiding rollers 27*a*, 27*b* and is connected to an upper portion of the counterweight 25. The counterweight 25 is conventionally used for balancing the movement of the beam 15, on which the print head 10 is mounted.

An sensor 30, which may according to the present embodiment a diffused optical sensor or another type of sensor (like, for example, an ultrasound sensor, a radar sensor, or the like), is attached to the print head 10, or, according to another modification, to the beam 15 or another portion of the positioning mechanism 20. In all configurations, the sensor 30 is positioned at an upstream side of the print head 10 and in proximity thereto.

The sensor 30 is configured to scan an area in front of the print head 10 so that the sensor 30 may detect a container C1, C2 approaching the print head 10. If the distance obtained by the sensor 30 is within a predetermined range or on a predetermined position, the container C1 may pass below the print head 10, which again provides a marking on an upper surface of the container C1. Under these circumstances, a control unit 50 of the marking assembly determines that no repositioning of the beam 15 carrying the print head 10 is required.

The control unit 50 is in the present case a centralized control unit provided for example on the printing head 10 or on any portion of the positioning mechanism 20, like on the servo motor 21. In other modifications, the control unit may be a main control unit of the conveyor 100. However, according to a further embodiment, the control unit 50 may also be a decentralized control unit.

The predetermined range/position is either entered manually by an operator or obtained by a corresponding sensor (not shown), like a laser sensor, located in the conveyor 100 at an upstream position of the print head 10.

The embodiment shown in the sole FIGURE provides a configuration, wherein a plurality of containers C1 is forwarded by the conveyor 100. The containers C1 have substantially the same height so that a printing operation may be performed without repositioning the print head 10.

If a container having a different height, like the container C2 shown in the sole FIGURE, approaches the print head 10, the print head 10 is usually repositioned on the basis of the predetermined position obtained or entered for a newly arriving container so that a marking may also be provided on an upper portion of the container C2.

However, if the height detection of the conveyor 100, which usually obtains the predetermined position well ahead of the print head 10 fails, or if some other unforeseen circumstances occur, like a defect of the sensor for obtaining the predetermined position or power failure, the container C2 having an increased height in comparison to the previous container C1 may approach the print head 10 which is still at a height position for printing an upper surface of a container C1 having a lower height.

Once the container C2 approaches the print head 10, the sensor 30 detects the container C2 and sends a signal to the control unit 50. Since the print head 10 is in a position which is not within the predetermined range and which would lead to a collision with an upper portion of the container C2, the control unit 50 may choose between two options.

In particular, the control unit 50 may according to a first option send a command to the servo motor 21 for elevating the print head 10 in a vertical direction with maximum speed, thereby avoiding a collision with the container C2 having an elevated height.

The control unit 50 may, however, evaluate that the servo motor 21 is not working properly, in particular if a command is send to the servo motor 21 and the control unit 50 receives no feedback from the servo motor 21. Alternatively, the control unit 50 may have detected a power failure or the control unit 50 may receive a signal from the collision sensor 30 that the collision sensor is not working properly. Under these circumstances, the control unit 50 detects a failure, for example due to a power failure or an overcurrent.

Alternatively, the control unit 50 may receive a feedback from the servo motor 50, but evaluates that the maximum speed will not be sufficient to avoid a collision with the approaching container C2.

In the abovementioned cases, where the control unit 50 evaluates that driving the servo motor 21 will not avoid a collision, the control unit 50 activates, according to a second option, the release device 22, thereby disengaging the printerhead arm.

Once the servo motor 21 is disengaged, the weight of the counterweight 25 lifts the print head 10 in a vertical direction. Consequently, no additional motor is required, but the movement of the beam 15 supporting the printing head 15 is initiated only on the basis of the weight of the counterweight 25. The counterweight 25 moves downwards, until the counterweight reaches a bumper that alleviates the impact of the counterweight.

Since the present embodiment provides the above mentioned options, and the control unit 50 is configured to perform either option 1 or option 2, a collision of a container with the print head 10 can be reliably avoided.

The invention claimed is:

1. A marking assembly, comprising:

a marking device, in particular a print head, configured to provide a marking on an object passing the marking device, a positioning mechanism, the positioning mechanism comprising an actuator for moving the marking device in a vertical direction, the positioning mechanism further comprising a counterweight, a release device for disengaging the actuator, the release device being a solenoid valve, a sensor, the sensor being suitable for detecting an object, in particular the height of the object, approaching the marking device, and a control unit configured to receive a signal from the sensor and configured to either activate the actuator to move the marking device to an elevated position with an increased speed or to activate the release device to disengage the actuator, thereby moving the marking device by the counterweight.

2. The marking assembly according to claim 1, wherein the sensor is an optical sensor, in particular a diffused optical sensor.

3. The marking assembly according to claim 1, wherein the actuator is a servomotor, in particular a servomotor with a mechanical spindle axis.

4. The marking assembly according to claim 1, wherein the control unit is configured to activate the release device, if activating the actuator fails.

5. The marking assembly according to claim 1, wherein the control unit is configured to detect a power failure so that the control unit activates the release device to disengage the actuator, thereby moving the marking device by the counterweight.

6. The marking assembly according to claim 1, wherein the control unit is configured to detect failure of the sensor so that the control unit activates the actuator to move the marking device to an elevated position.

7. The marking assembly according to claim 1, wherein the control unit is configured to detect a failure of the actuator so that the control unit activates the release device to disengage the actuator, thereby moving the marking device by the counterweight.

8. The marking assembly according to claim 1, wherein the marking device is provided on a beam movably guided by a vertical guide, wherein the actuator and/or the release device are mounted on the beam.

9. The marking assembly according to claim 1, wherein the increased speed is a maximum speed of the actuator.

10. The marking assembly according to claim 1, wherein the control unit is a centralized control unit.

11. A conveyor comprising a conveying element for conveying objects and a marking assembly according to claim 1.

12. A method for adjusting a position of a marking device of a marking assembly according to claim 1, the method comprising the steps of:

moving an object, in particular a container, in a conveying direction, detecting the object by a sensor provided on or in proximity to the marking device of the marking assembly, and determining to activate an actuator for moving the marking device to an elevated position with an increased speed, or to activate a release device for disengaging the actuator, thereby elevating the marking device by a counterweight connected to the marking device.

13. The method according to claim 12, wherein activating the release device is determined, if activating the actuator fails or if a failure of the actuator is detected.

14. The method according to claim 12, wherein activating the release device is determined, if a power failure is detected.

15. The method according to claim 12, wherein activating the actuator to move the marking device to an elevated position is determined, if a failure of the sensor is detected.

* * * * *